US010903609B2

(12) United States Patent
Tanaka et al.

(10) Patent No.: US 10,903,609 B2
(45) Date of Patent: Jan. 26, 2021

(54) CONNECTOR

(71) Applicant: FUJITSU COMPONENT LIMITED, Tokyo (JP)

(72) Inventors: Tetsugaku Tanaka, Tokyo (JP); Koichi Kiryu, Nagano (JP); Koki Sato, Tokyo (JP); Kyohei Seki, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/707,304

(22) Filed: Dec. 9, 2019

(65) Prior Publication Data

US 2020/0185867 A1 Jun. 11, 2020

(30) Foreign Application Priority Data

Dec. 11, 2018 (JP) ..... 2018-231989

(51) Int. Cl.
*H01R 13/703* (2006.01)
*H01R 13/44* (2006.01)

(52) U.S. Cl.
CPC ..... *H01R 13/7032* (2013.01); *H01R 13/44* (2013.01)

(58) Field of Classification Search
CPC ..... H01R 13/7032; H01R 13/44; H01R 2103/00; H01H 1/5866; H01H 3/3015; H01H 3/42
USPC ..... 439/188; 200/51 R, 51.09, 573, 574
See application file for complete search history.

(56) References Cited

U.S. PATENT DOCUMENTS 4,381,437 A * 4/1983 Geremia ..... H01H 19/62 200/47
4,525,608 A * 6/1985 Cushing ..... H01H 43/125 200/38 B
4,778,955 A * 10/1988 Atsumi ..... H01H 21/285 200/327
4,853,502 A * 8/1989 Canipe ..... H01H 3/166 200/61.89
5,320,545 A * 6/1994 Brothers ..... H01R 13/7036 200/51.09
5,964,607 A * 10/1999 Finke ..... H01R 24/46 439/188
6,037,551 A * 3/2000 Fukui ..... H01H 27/002 200/43.04
6,045,378 A * 4/2000 Follingstad ..... H01R 24/46 439/188

(Continued)

FOREIGN PATENT DOCUMENTS

JP 2017-130426 7/2017

*Primary Examiner* — Gary F Paumen
(74) *Attorney, Agent, or Firm* — IPUSA, PLLC

(57) ABSTRACT

A connector to be connected to another connector includes a fixed contact, a movable contact, a housing having an opening into which the other connector is insertable, a switch that is movable in a direction in which the other connector is inserted, a cam that is rotatably supported and includes a first cam and a second cam, and a card that moves the movable contact. The connector is configured such that when the other connector is inserted into the connector, the switch is pushed and moved by the other connector, the first cam is pushed by the switch and the cam rotates, the second cam pushes the card when the cam rotates, and the card moves the movable contact to contact the fixed contact.

4 Claims, 13 Drawing Sheets

(56) References Cited

U.S. PATENT DOCUMENTS

| | | | | |
|---|---|---|---|---|
| 6,111,210 | A * | 8/2000 | Allison | H01R 13/7036 200/51.09 |
| 6,229,107 | B1 * | 5/2001 | Flint | H01R 13/652 200/51.09 |
| 6,455,789 | B1 * | 9/2002 | Allison | H01R 13/7036 200/51.09 |
| 6,749,449 | B2 * | 6/2004 | Mortun | H01R 13/703 200/51.09 |
| 9,787,036 | B2 | 10/2017 | Kiryu et al. | |
| 2003/0036299 | A1 * | 2/2003 | Patterson | H01R 13/7031 439/188 |
| 2010/0326810 | A1 * | 12/2010 | Song | H01R 11/0018 200/574 |
| 2011/0171843 | A1 * | 7/2011 | Casses | B60L 53/16 439/188 |

* cited by examiner

CONNECTOR

CROSS-REFERENCE TO RELATED APPLICATION

The present application is based on and claims priority to Japanese Patent Application No. 2018-231989, filed on Dec. 11, 2018, the entire contents of which are incorporated herein by reference.

BACKGROUND OF THE INVENTION

1. Field of the Invention

An aspect of this disclosure relates to a connector.

2. Description of the Related Art

Japanese Laid-Open Patent Publication No. 2017-130426 discloses a connector that instantaneously shuts off a switch using a return spring to suppress an arc.

SUMMARY OF THE INVENTION

In an aspect of this disclosure, there is provided a connector to be connected to another connector. The connector includes a fixed contact, a movable contact, a housing having an opening into which the other connector is insertable, a switch that is movable in a direction in which the other connector is inserted, a cam that is rotatably supported and includes a first cam and a second cam, and a card that moves the movable contact. The connector is configured such that when the other connector is inserted into the connector, the switch is pushed and moved by the other connector, the first cam is pushed by the switch and the cam rotates, the second cam pushes the card when the cam rotates, and the card moves the movable contact to contact the fixed contact.

DESCRIPTION OF EMBODIMENTS

Embodiments of the present invention are described below with reference to the accompanying drawings. The same reference number is assigned to the same component throughout the drawings, and repeated descriptions of that component may be omitted.

Figure 1:
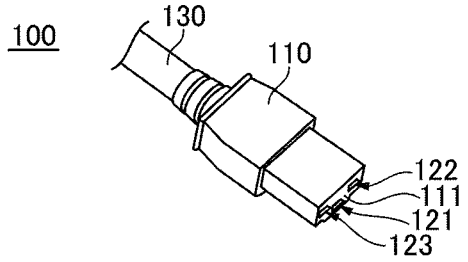
FIG. 1 is a perspective view of a jack connector.

A connector according to an embodiment is a plug connector (hereafter referred to as a "plug"), to be connected to a jack connector (hereafter referred to as a "jack") illustrated in FIG. 1. Each of a jack and a plug may also be referred to as a "connector".

FIG. 1 is a perspective view of a jack 100.

The jack 100 includes a housing 110. A surface 111 of the housing 110 to be inserted into a plug 200 has openings 121, 122, and 123 in which jack terminals are provided. Plug terminals are to be inserted in the openings 121, 122, and 123. A cable 130 for supplying power is connected to the housing 110.

Figure 2:
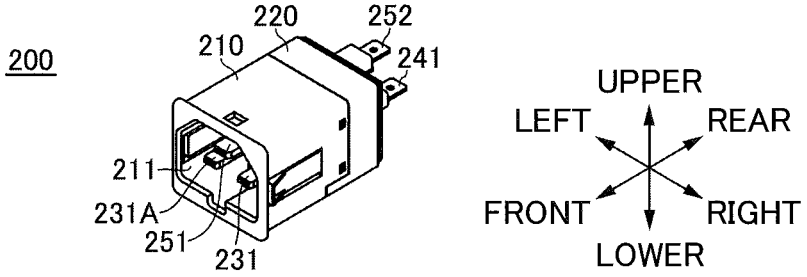
FIG. 2 is a perspective view of a plug connector.
Figure 3:
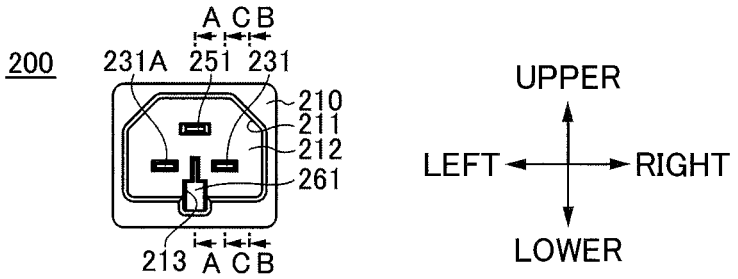
FIG. 3 is a front view of a plug connector.
Figure 4:
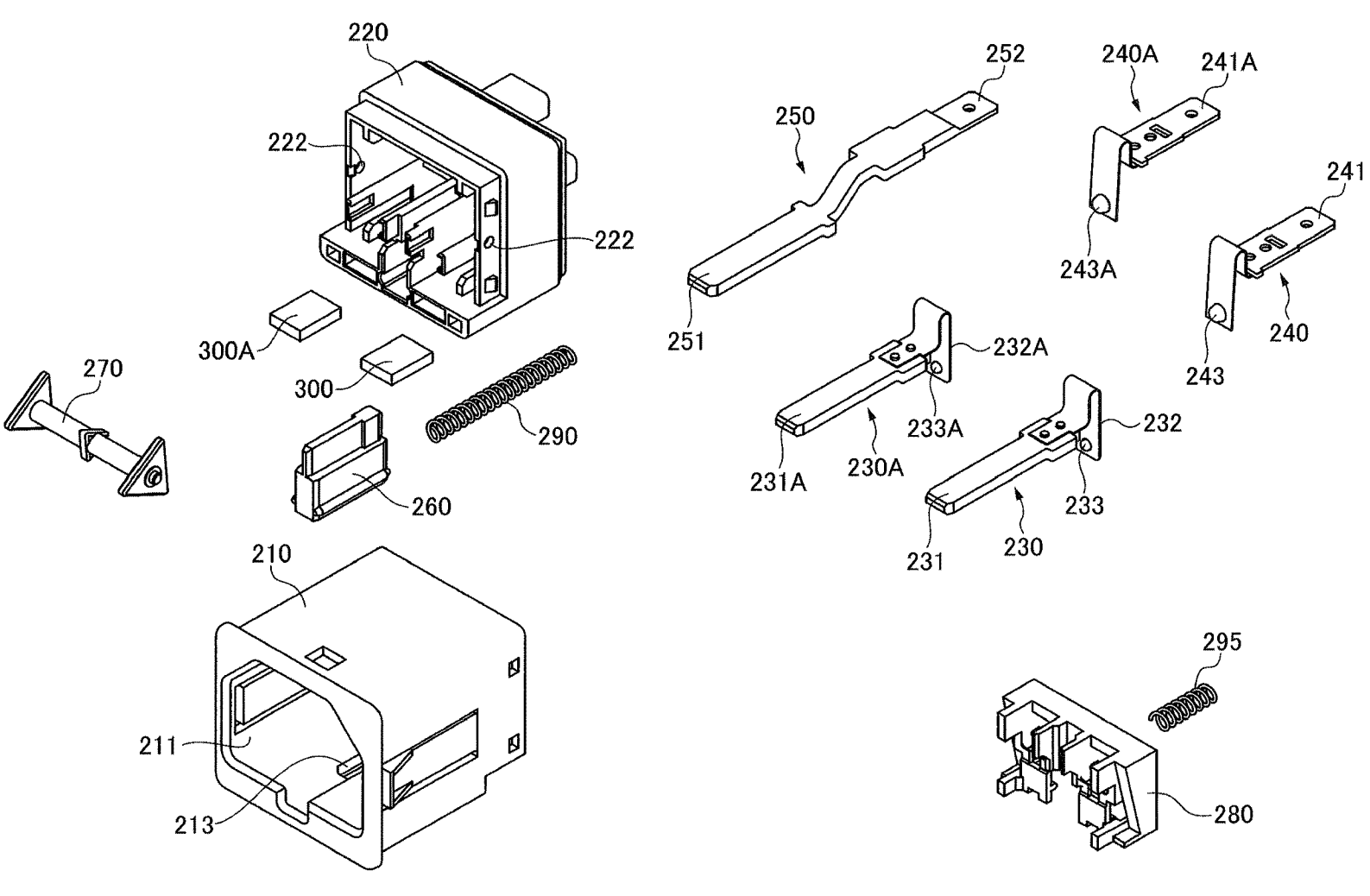
FIG. 4 is an exploded perspective view of a plug connector.
Figure 5:
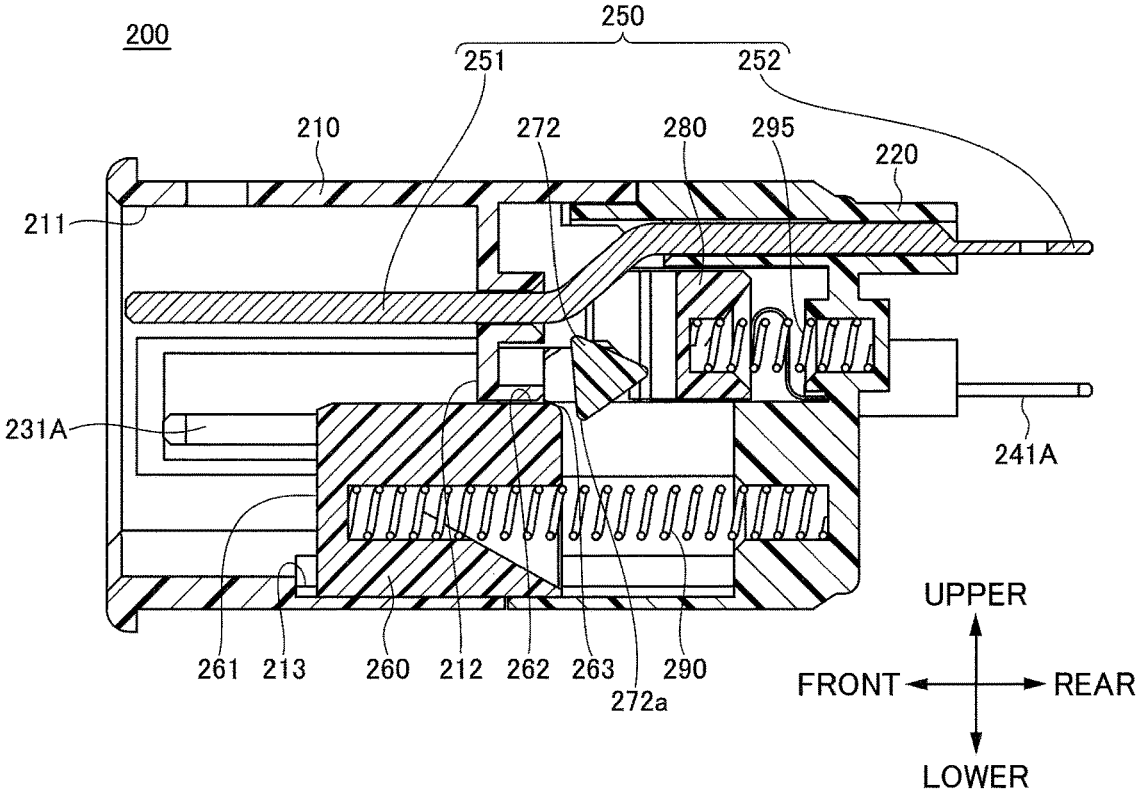
FIG. 5 is a cross-sectional view of a plug connector taken along line A-A.
Figure 6:
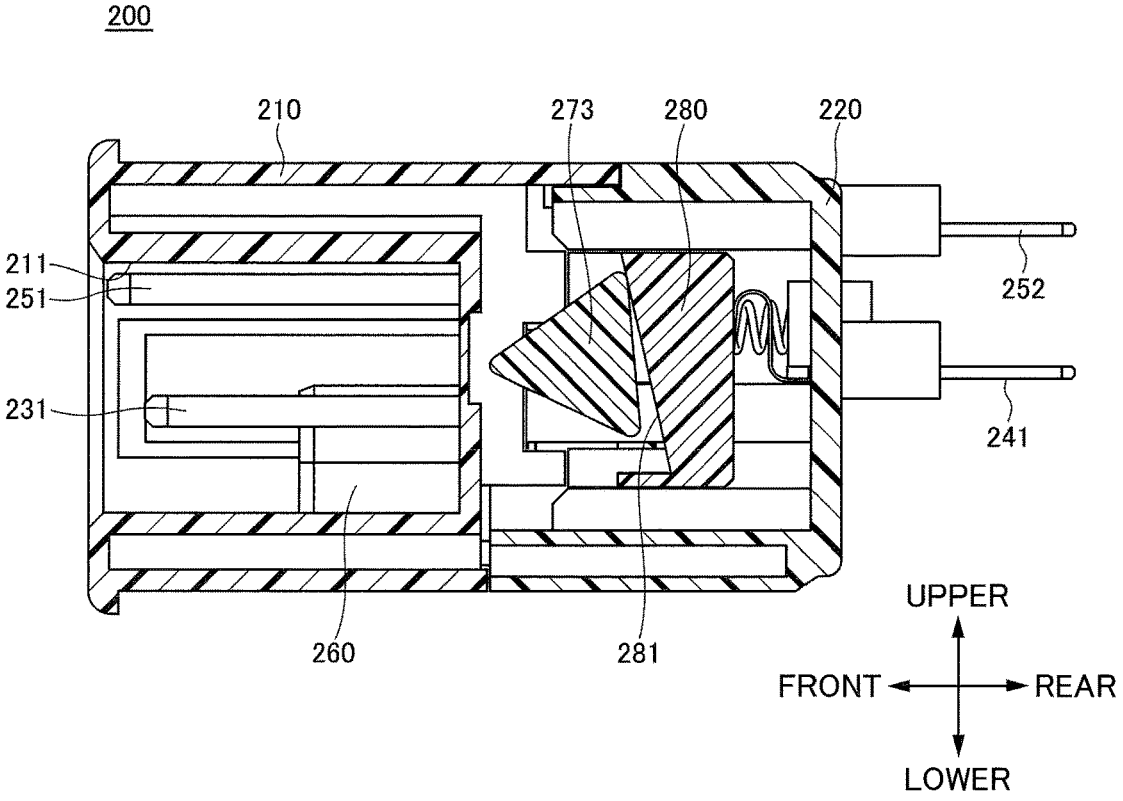
FIG. 6 is a cross-sectional view of a plug connector taken along line B-B.
Figure 7:
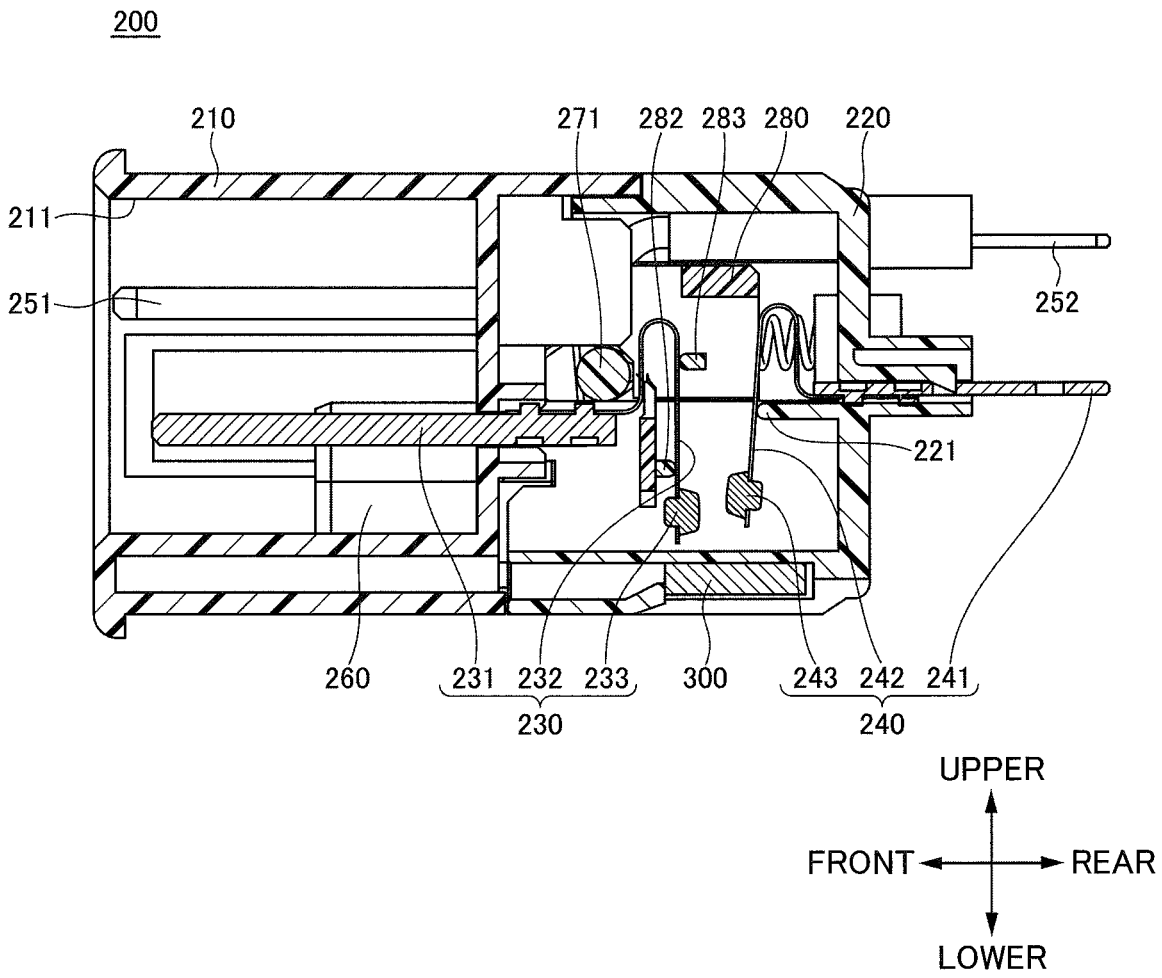
FIG. 7 is a cross-sectional view of a plug connector taken along line C-C.
Figure 8:
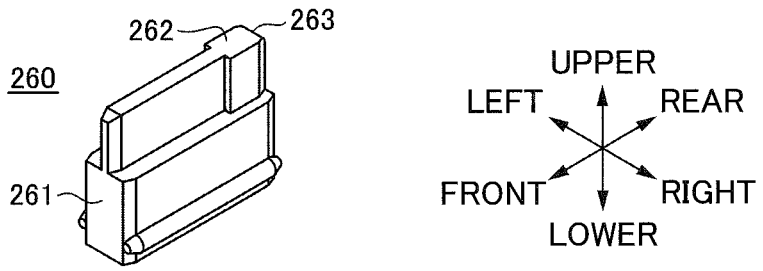
FIG. 8 is a perspective view of a switch.
Figure 9:
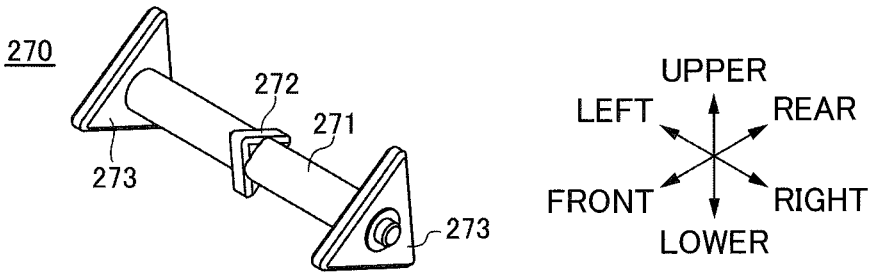
FIG. 9 is a perspective view of a cam.

A plug 200 according to the present embodiment is described. FIG. 2 is a perspective view, FIG. 3 is a front view, and FIG. 4 is an exploded perspective view of the plug 200. FIG. 5 is a cross-sectional view taken along line A-A, FIG. 6 is a cross-sectional view taken along line B-B, and FIG. 7 is a cross-sectional view taken along line C-C of the plug 200. Hereafter, the direction in which the jack 100 is inserted is referred to as a backward or rear direction, and a direction in which the jack 100 is pulled out is referred to as a forward or front direction. Also, an upper direction, a lower direction, a left direction, and a right direction are indicated in FIG. 3.

The plug 200 includes a front housing 210, a rear housing 220, plug modules 230, 230A, and 250, output modules 240 and 240A, a switch 260, a cam 270, a card 280, a switch spring 290, a card spring 295, and permanent magnets 300 and 300A. The plug modules and the output modules are formed of a metal.

The front housing 210 and the rear housing 220 forms a housing of the plug 200 and are collectively referred to as a "housing". An opening 211 into which the jack 100 is to be inserted is formed in the front side of the front housing 210.

The plug module 230 includes a plug terminal 231, a spring 232, and a movable contact 233. The terminal 231 is fixed to the housing, and one end of the terminal 231 is placed in the opening 211. The spring 232 is a leaf spring. One end of the spring 232 is fixed to the other end of the terminal 231, and the movable contact 233 is provided on the other end of the spring 232. The spring 232 is supported from the front by a front support 282 of the card 280 and is supported from behind by a rear support 283 of the card 280.

The output module 240 includes an output terminal 241, a spring 242, and a fixed contact 243. The terminal 241 is fixed to the rear housing 220, and one end of the terminal 241 protrudes backward from the rear housing 220. The spring 242 is a leaf spring. One end of the spring 242 is fixed to the other end of the terminal 241, and the fixed contact 243 is provided on the other end of the spring 242. The spring 242 is supported from behind by a support 221 of the rear housing 220.

The plug module 230A and the output module 240A have substantially the same configurations as those of the plug module 230 and the output module 240, and therefore their descriptions are omitted here.

The plug module 250 includes a plug terminal 251 and an output terminal 252. One end of the terminal 251 is placed in the opening 211, and one end of the terminal 252 protrudes backward from the rear housing 220.

The plug 200 includes the plug terminals 231, 231A, and 251 in the opening 211, and the output terminals 241, 241A, and 252 near the rear end. The connection between the terminal 231 and the terminal 241 can be switched by switching the contact state between the movable contact 233 and the fixed contact 243. Similarly, the connection between the terminal 231A and the terminal 241A can be switched by switching the contact state between the movable contact 233A and the fixed contact 243A. The terminal 251 is used as a ground terminal, and the front side of the terminal 251 is longer than the terminals 231 and 231A. When the jack 100 is inserted into the plug 200, the terminal 251 contacts the jack terminal before the terminals 231 and 231A contact the jack terminals.

As illustrated in FIG. 7, the magnet 300 is provided near the position where the movable contact 233 contacts the fixed contact 243. The magnet 300 is positioned so that a magnetic field is generated in a direction perpendicular to the direction in which an arc is generated between the movable contact 233 and the fixed contact 243 and the arc is extinguished by the magnetic field. The magnet 300A is provided near the position where the movable contact 233A contacts the fixed contact 243A.

A surface 261 which is to contact the jack 100 is formed on the front side of the switch 260. A surface 262 which locks a first cam 272 is formed on the upper rear side of the switch 260. The rear end of the surface 262 serves as a contact part 263 that contacts the first cam 272.

A recess 213 passing through a bottom wall 212 is formed in the lower surface of the front housing 210. The switch 260 is disposed such that the switch 260 extends along the recess 213 from behind the wall 212, and the upper front portion of the switch 260 enters the opening 211. The switch 260 is movable in the forward and backward directions. A spring 290 disposed between the rear side of the switch 260 and the rear housing 220 biases the switch 260 forward.

The cam 270 includes a shaft 271, the first cam 272, and second cams 273. The first cam 272 is disposed substantially in the middle of the cam 270 and has a triangular shape with round corners. The second cams 273 are disposed at the right and left ends of the cam 270 and have a triangular shape with round corners. Each second cam 273 is oriented to form an inverted triangular shape with respect to the first cam 272 and is larger than the first cam 272. The first cam 272 and the second cams 273 may have a polygonal shape other than a triangular shape.

The cam 270 is disposed in the housing, and the ends of the shaft 271 are rotatably supported by holes 222 of the rear housing 220.

Figure 10:
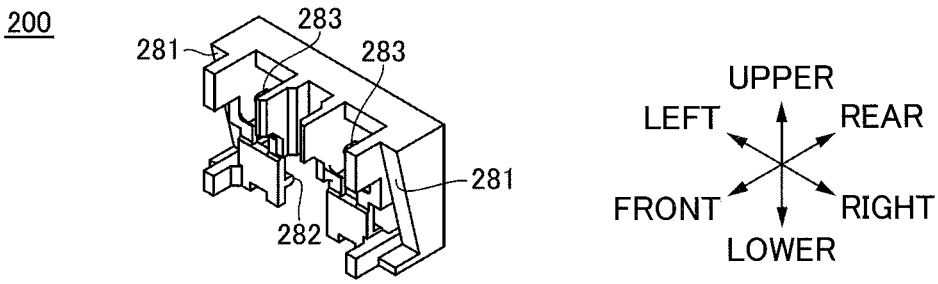
FIG. 10 is a perspective view of a card.

Surfaces 281 which contact the second cams 273 are formed at the right and left front ends of the card 280. Each surface 281 is inclined such that its upper portion is located in a more forward position than its lower portion. However, the shape of the surface 281 is not limited to that illustrated in FIG. 10, and the surface 281 may be not inclined. The front support 282 and the rear support 283 of the card 280 support the spring 232 from the front and from behind. When the card 280 moves backward, the support 282 pushes the spring 232, and the movable contact 233 moves toward and contact the fixed contact 243. When the card 280 moves forward, the support 283 pushes the spring 232 forward and the movable contact 233 is disconnected from the fixed contact 243. One set of the support 282 and the support 283 is provided for each of the plug modules 230 and 230A on the right and left sides.

The card 280 is movable forward and backward in the housing. A spring 295 is provided between the card 280 and the rear housing 220 to bias the card 280 forward.

An operation to insert the jack 100 into the plug 200 is described below.

Figure 11:
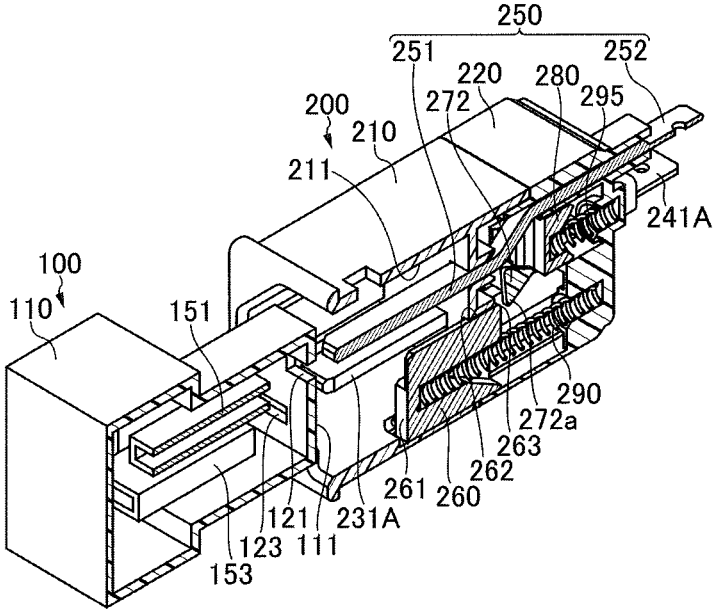
FIG. 11 is a perspective cross-sectional view, taken along line A-A, of a plug connector before being inserted into a jack connector.
Figure 12:
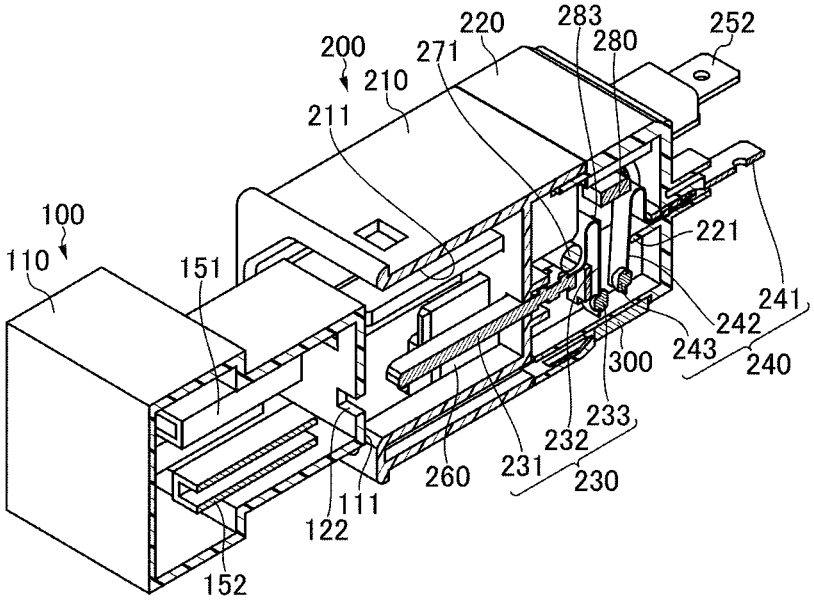
FIG. 12 is a perspective cross-sectional view, taken along line C-C, of a plug connector before being inserted into a jack connector.

FIGS. 11 and 12 are cross-sectional views of the plug 200 before the jack 100 is inserted. FIG. 11 is a cross-sectional view taken along line A-A. FIG. 12 is a cross-sectional view taken along line C-C.

The jack 100 includes jack terminals 151, 152, and 153 disposed in the openings 121, 122, and 123. In FIGS. 11 and 12, the jack 100 is schematically illustrated, and its internal structure and the cable 130 are omitted.

In FIGS. 5 and 11, the switch 260 biased by the spring 290 and the card 280 biased by the spring 295 are in initial positions. As illustrated in FIGS. 7 and 12, when the card 280 is in the initial position, the spring 232 is pushed from behind by the support 283 and the movable contact 233 is apart from the fixed contact 243. As illustrated in FIG. 6, an upper protrusion of the second cam 273 is in contact with the surface 281; and as illustrated in FIGS. 5 and 11, the tip of a first protrusion 272*a* of the first cam 272 is positioned lower than the surface 262.

Figure 13A:
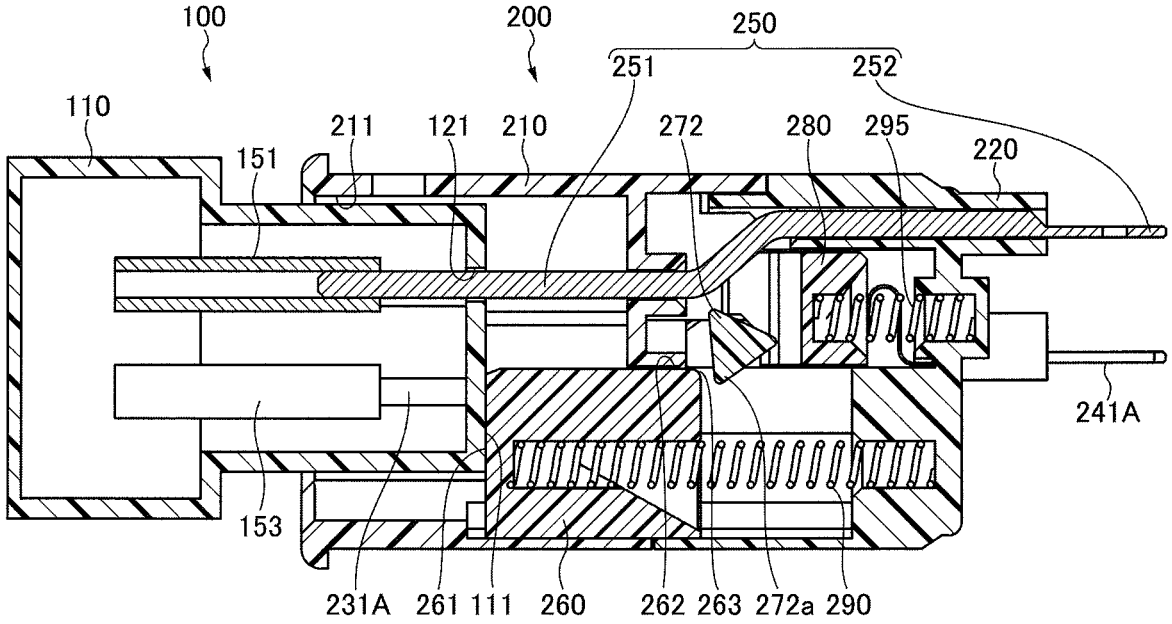
FIGS. 13A and 13B are cross-sectional views of a jack connector in contact with a switch.
Figure 13B:
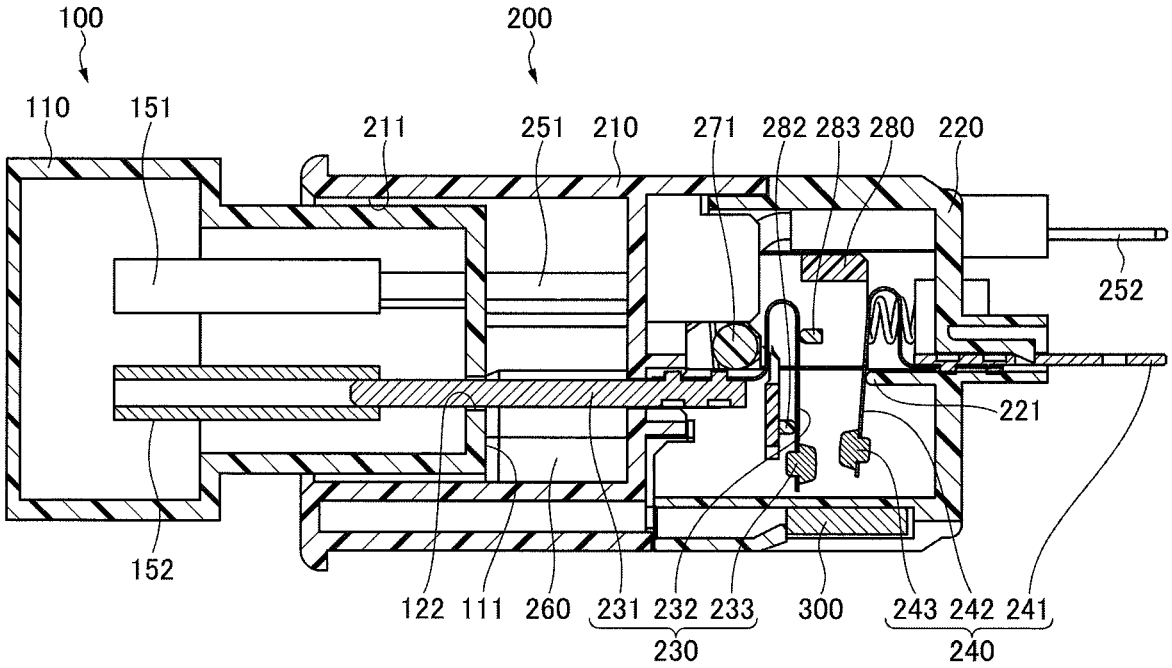

FIGS. 13A and 13B are cross-sectional views of the jack 100 that is in contact with switch 260. FIG. 13A is a cross-sectional view taken along line A-A, and FIG. 13B is a cross-sectional view taken along line C-C.

When the jack 100 is inserted into the plug 200, the surface 111 contacts the surface 261. In this state, the terminal 151 contacts the terminal 251, the terminal 152 contacts the terminal 231, and the terminal 153 contacts the terminal 231A. Meanwhile, the first cam 272 is not in contact with the switch 260, and the cam 270 and the card 280 maintain the initial state. Therefore, as illustrated in FIG. 13B, the movable contact 233 is apart from the fixed contact 243 and the terminal 241 is not electrically connected with the terminal 152. When the jack 100 is inserted further, the switch 260 moves backward.

Figure 14A:
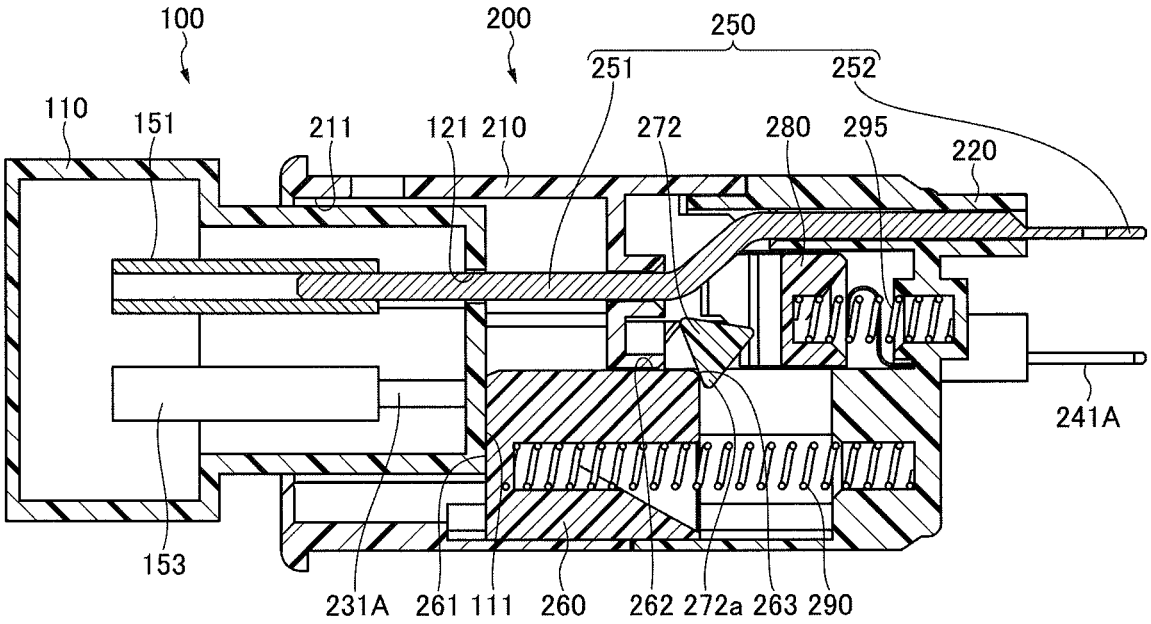
FIGS. 14A and 14B are cross-sectional views of a switch in contact with a first cam.
Figure 14B:
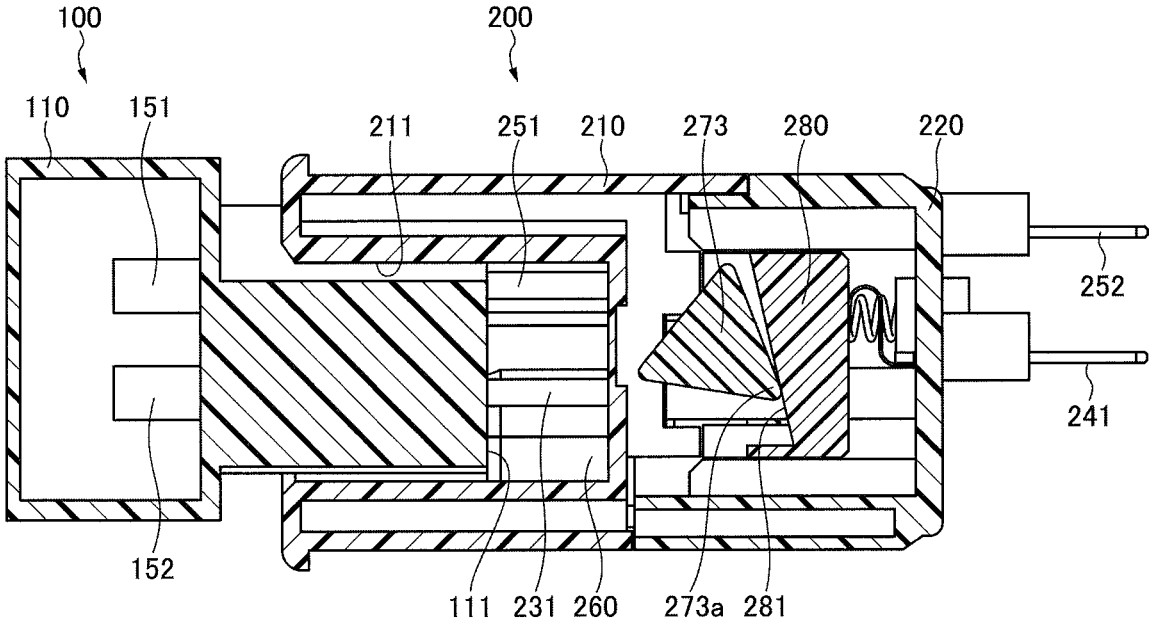

FIGS. 14A and 14B are cross-sectional views where the switch 260 is in contact with the first cam 272. FIG. 14A is a cross-sectional view taken along line A-A, and FIG. 14B is a cross-sectional view taken along line B-B.

When the jack 100 is pushed further into the plug 200 from the position in FIG. 13A to the position in FIG. 14A, the switch 260 is pushed by the surface 111 and moves backward, and the protrusion 272*a* contacts the contact part 263. When the jack 100 is pushed further, the switch 260 moves further backward, the first cam 272 pushed by the contact part 263 rotates counterclockwise, and the second cam 273 rotates counterclockwise and a lower protrusion 273*a* of the second cam 273 contacts the surface 281. When the protrusion 273*a* contacts the surface 281, the card 280 is pushed backward as the cam 270 rotates. In FIG. 14A, the card 280 has not been pushed, and the movable contact 233 is apart from the fixed contact 243.

Because the spring 295 biases the card 280 forward, a force is applied to the cam 270 in such a direction that the protrusion 273*a* contacting the surface 281 is pushed forward and the second cam 273 is rotated clockwise.

Figure 15A:
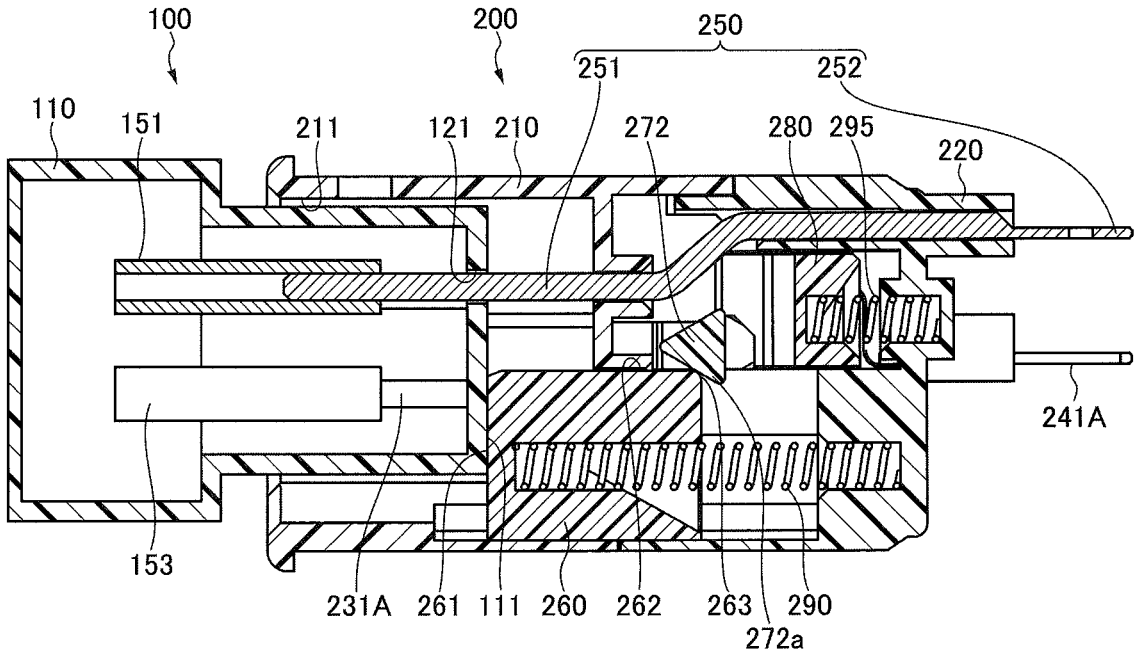
FIGS. 15A, 15B and 15C are cross-sectional views of a plug connector where a movable contact is in contact with a fixed contact.
Figure 15B:
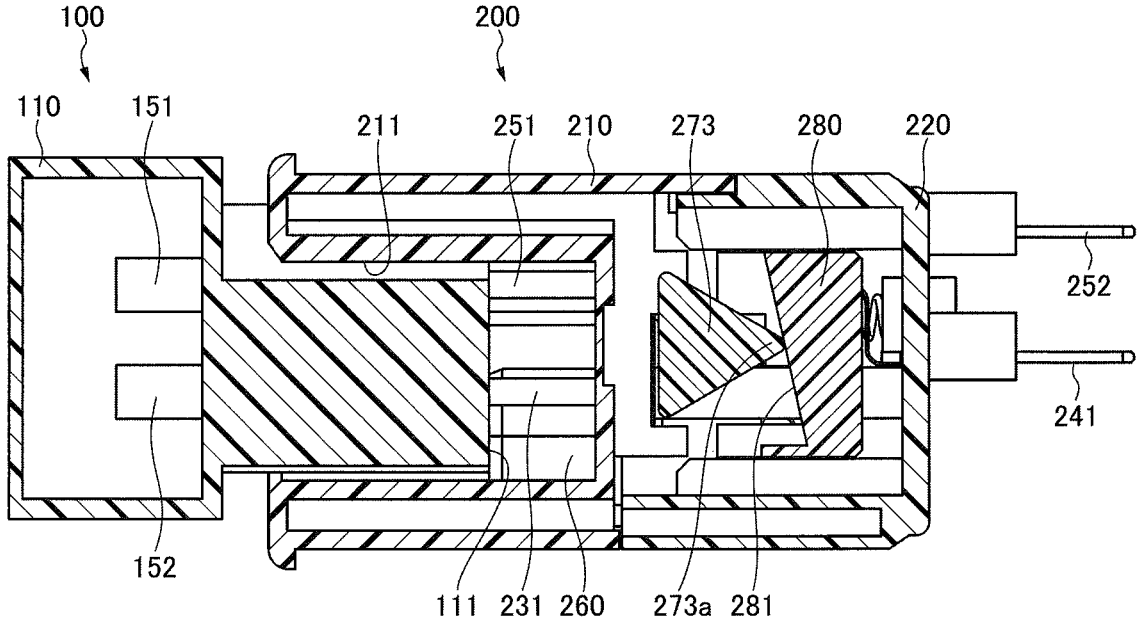
Figure 15C:
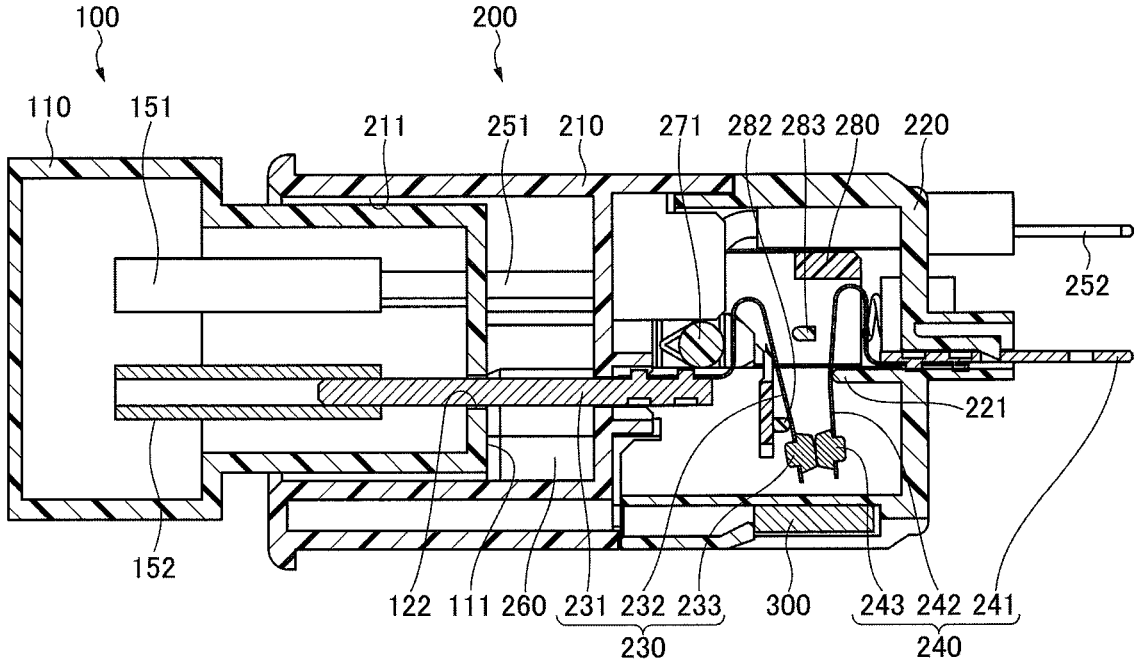

FIGS. 15A through 15C are cross-sectional views where the movable contact 233 is in contact with the fixed contact 243. FIGS. 15A, 15B and 15C are cross-sectional views taken along line A-A, line B-B, and line C-C, respectively.

When the jack 100 is pushed further from the position illustrated in FIG. 14A, the switch 260 is pushed further backward and the first cam 272 rotates counterclockwise as illustrated in FIG. 15A. As a result, the second cam 273 rotates counterclockwise, the protrusion 273*a* pushes the card 280, and the card 280 moves backward from the position illustrated in FIG. 14B. When the card 280 moves backward, the front support 282 pushes the spring 232 backward, and the movable contact 233 contacts the fixed contact 243. Even in this state, the card 280 is being biased forward by the spring 295 and presses the protrusion 273*a* in such a direction that the cam 270 is rotated clockwise.

Figure 16A:
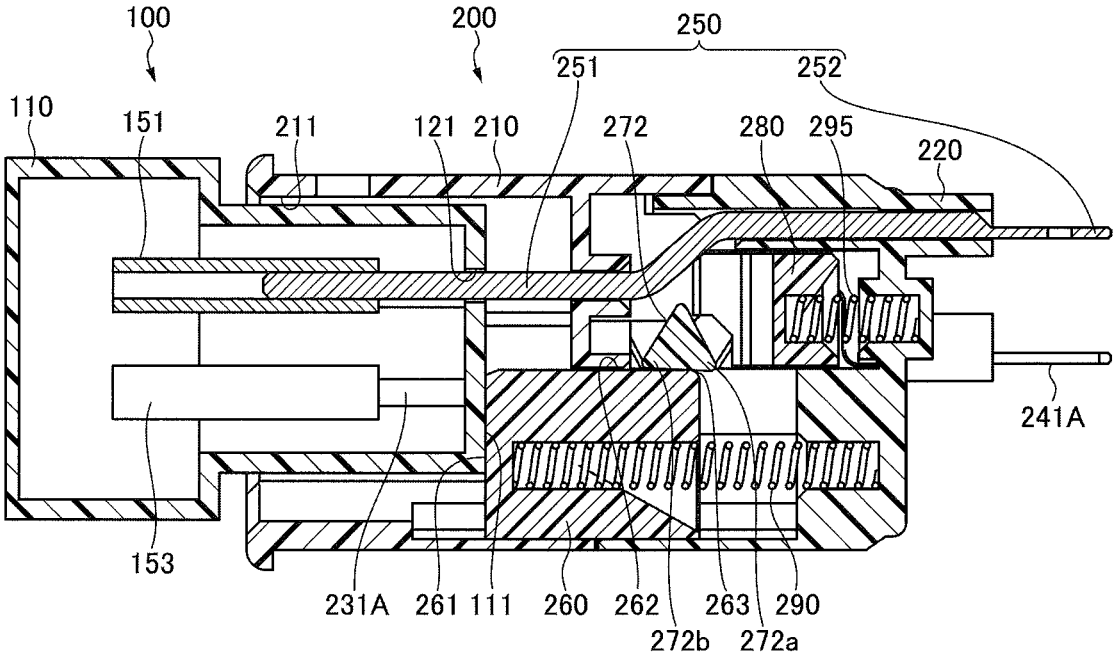
FIGS. 16A and 16B are cross-sectional views of a plug connector where a protrusion is positioned above a rotation center.
Figure 16B:
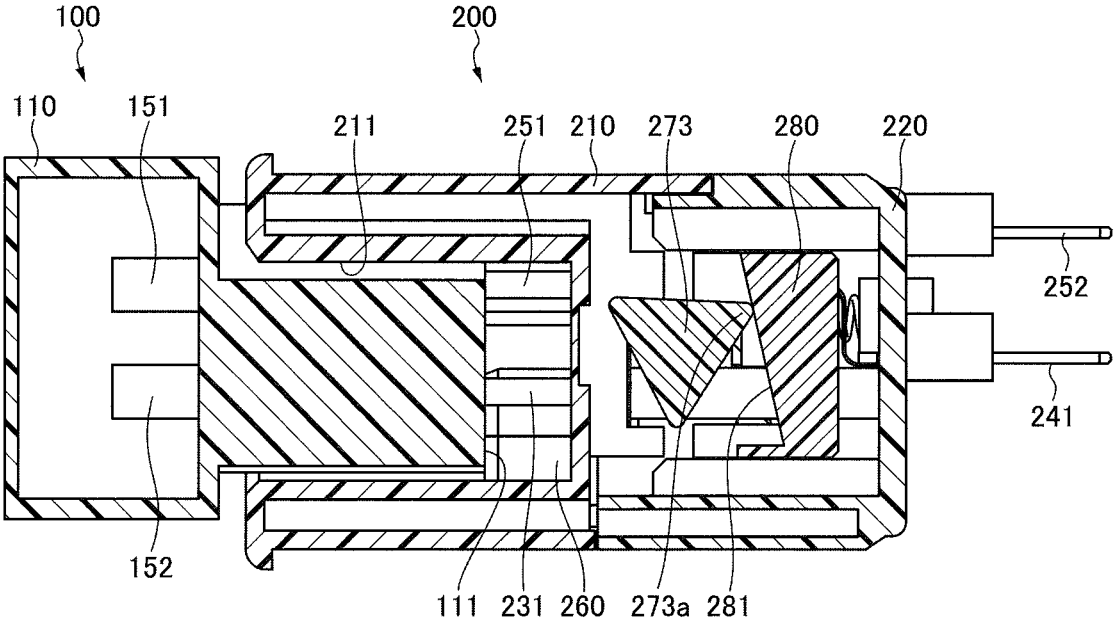

FIGS. 16A and 16B are cross-sectional views where the protrusion 273*a* is located higher than the rotation center of the cam 270. FIGS. 16A and 16B are cross-sectional views taken along line A-A and line B-B, respectively.

When the jack 100 is pushed further from the position illustrated in FIG. 15A, the first cam 272 pushed by the switch 260 further rotates counterclockwise. As illustrated in FIG. 16B, the second cam 273 rotates further, and the protrusion 273*a* moves to a position higher than the rotation center of the cam 270. In this state, at least a second protrusion 272*b* of the first cam 272 contacts the surface 262.

The card 280 being biased by the spring 295 pushes the protrusion 273*a* in contact with the surface 281 forward. However, because the protrusion 273*a* is positioned higher than the rotation center of the cam 270 as illustrated in FIG. 16B, a force to rotate the second cam 273 counterclockwise is applied to the second cam 273. Meanwhile, because the switch 260 is positioned under the first cam 272 and the second protrusion 272*b* is in contact with the surface 262 in FIG. 16A, the rotation of the first cam 272 is prevented by the surface 262 even if a force is applied to the second cam 273. As a result, the cam 270 and the card 280 are locked, and the contact between the movable contact 233 and the fixed contact 243 is maintained. In this state, the insertion of the jack 100 into the plug 200 is completed.

Figure 17A:
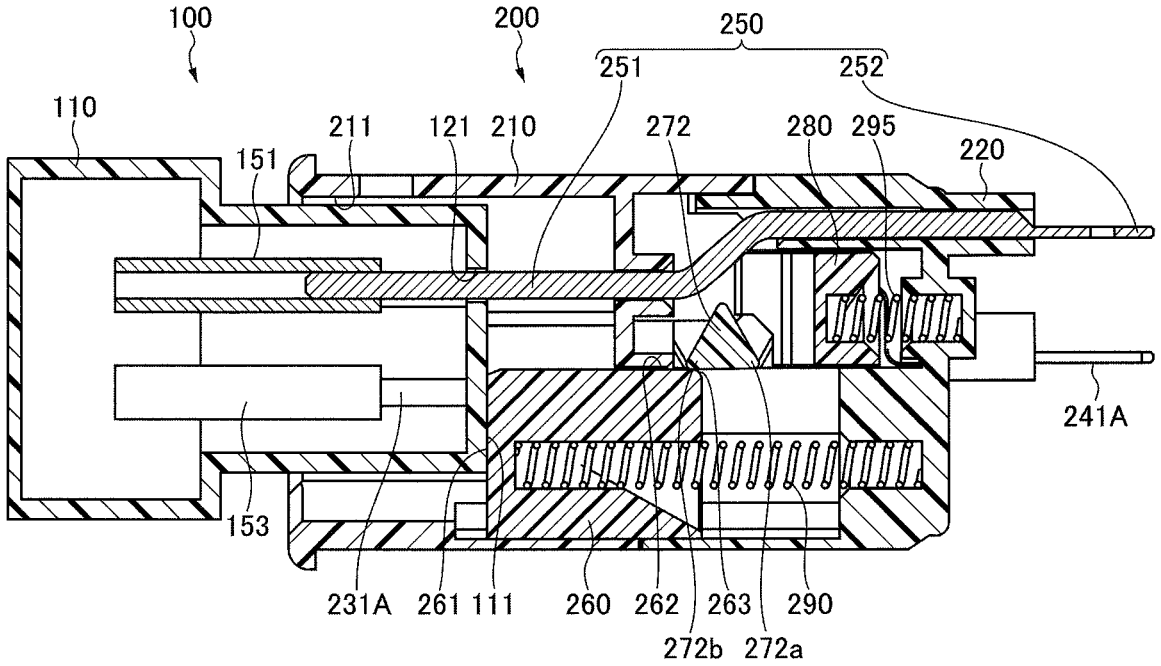
FIGS. 17A and 17B are cross-sectional views of a jack connector being pulled out of a plug connector.
Figure 17B:
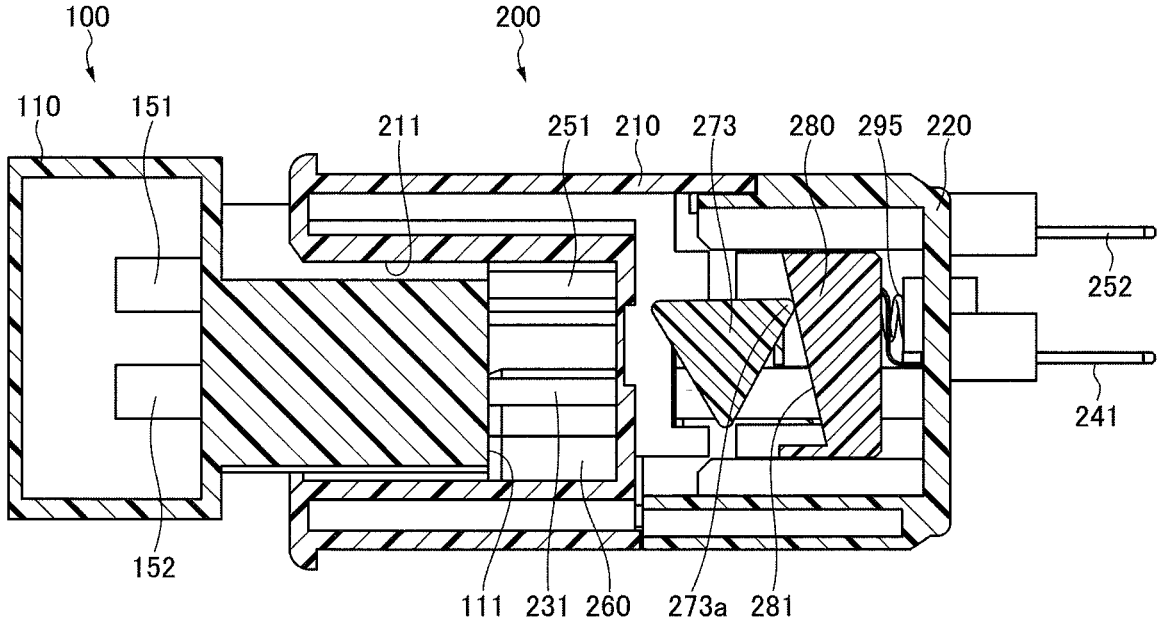

FIGS. 17A and 17B are drawings describing an operation of pulling the jack 100 out of the plug 200. FIG. 17A is a cross-sectional view taken along line A-A. FIG. 17B is a cross-sectional view taken along line B-B.

As illustrated in FIG. 17B, the protrusion 273*a* is pushed forward by the card 280 biased by the spring 295, and a force is applied to the cam 270 in the counterclockwise direction. However, because the protrusion 272*b* is in contact with the surface 262, the cam 270 is kept in the state illustrated in FIG. 16A. Therefore, the card 280 does not move, and the movable contact 233 remains in contact with the fixed contact 243.

Figure 18A:
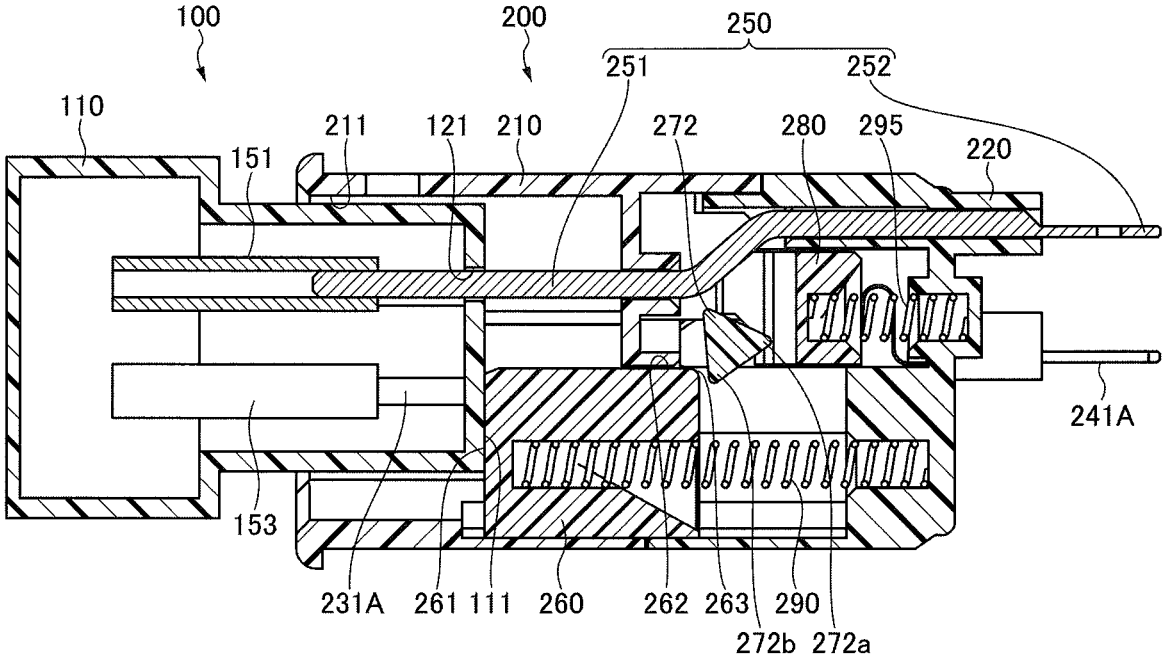
FIGS. 18A and 18B are cross-sectional views where a jack connector is fully pulled out.
Figure 18B:
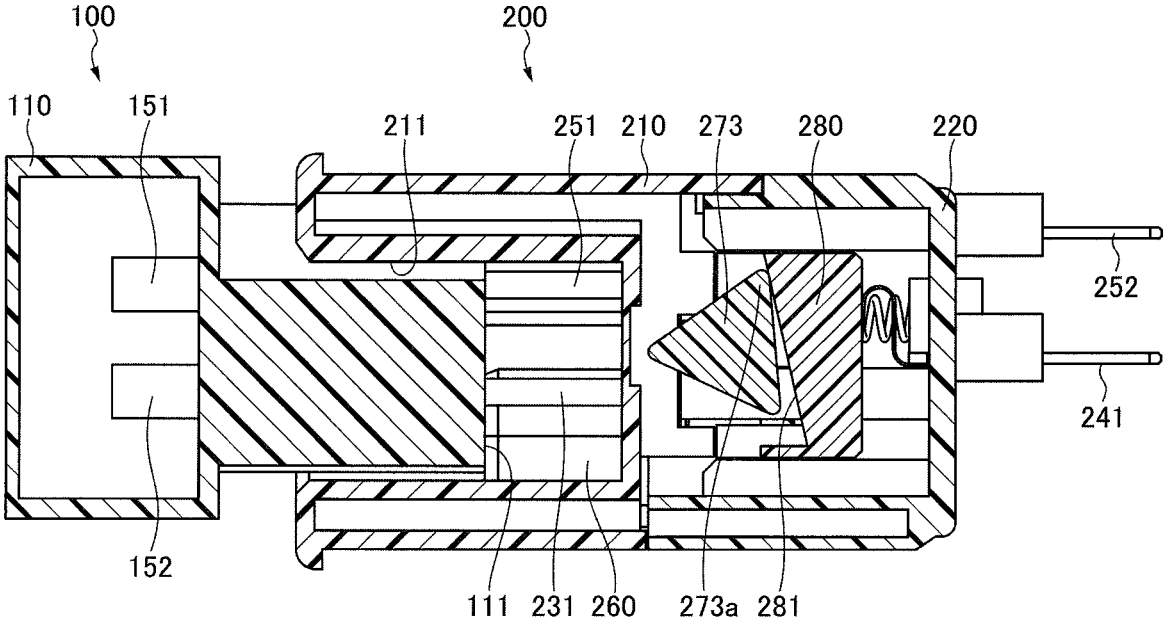

FIGS. 18A and 18B are cross-sectional views where the jack 100 is fully pulled out. FIGS. 18A and 18B are cross-sectional views taken along line A-A and line B-B, respectively.

When the jack 100 is further pulled out from the position in FIG. 17A, the spring 290 moves the switch 260 forward. As a result, the protrusion 272*b* is disengaged from the surface 262, the cam 270 becomes rotatable, and the card 280 which had been stopped by the protrusion 273*a* moves forward. Because the card 280 moves rapidly by the spring 295 at the moment when the protrusion 272*b* is disengaged from the rear end of the surface 262, the support 283 pushes the spring 232 forward and the movable contact 233 is instantaneously disconnected from the fixed contact 243.

When the jack 100 is pulled out of the plug 200, the switch 260, the card 280, and the cam 270 are restored to the initial states.

In FIGS. 18A and 18B, the terminals 151, 152, and 153 are in contact with the terminals 251, 231, and 231A. However, no electricity is flowing between the terminals 152 and 153 and the terminals 231 and 231A because the movable contacts 233 is disconnected from the fixed contacts 243 before the terminals 152 and 153 are disconnected from the terminals 231 and 231A. Therefore, no arc is generated between the terminals 152 and 153 and the terminals 231 and 231A when the terminals 152 and 153 are disconnected from the terminals 231 and 231A.

Because the movable contact 233 is instantaneously disconnected from the fixed contact 243 by the movement of the card 280 biased by the spring 295, the influence of an arc generated between separating contacts can be reduced. Also, because the permanent magnet 300 can extinguish an arc, the influence of the arc can be more effectively reduced.

According to the present embodiment, even if the jack 100 is slowly pulled out of the plug 200, the card 280 can move forward rapidly by the spring 295 when the protrusion 272*b* is disengaged from the surface 262, and the movable contact 233 is instantaneously disconnected from the fixed contact 243. This configuration can suppress the generation of an arc between the movable contact 233 and the fixed contact 243. Also, according the present embodiment, the generation of an arc can be suppressed without providing an unlocking mechanism in the jack 100.

According to the present embodiment, a connector can be produced with a small number of parts without using semiconductor devices and/or complex mechanisms, and a reliable contact can be produced with no complex mechanism at low cost.

The protrusion 273*a* is at the rearmost position when the protrusion 273*a* and the rotation center of the cam 270 are in the same vertical position, and moves forward as the cam 270 rotates. Besides, one side of the first cam 272 contacts the surface 262 and the protrusion 273*a* is positioned higher than the rotation center of the cam 270 when the jack 100 is completely inserted. At this time, the card 280 pressed by the protrusion 273*a* is at the rearmost position because the surface 281 is inclined such that its upper portion is located in a more forward position than its lower portion.

The moving distance of the card 280 between the positions in FIGS. 6 and 16B becomes greater than that in a configuration where the surface 281 is not inclined. The movement distance of the spring 232 sandwiched between the support 282 and the support 283 increases as the moving distance of the card 280 increases. Therefore, the distance between the movable contact 233 and the fixed contact 243 that are separated from each other when the jack 100 is pulled out of the plug 200 can be increased, and thereby makes it possible to reliably stop the flow of electricity.

The first cam 272 and the second cam 273 may have the other polygonal shape. However, the shape of a cam becomes closer to a circle as the number of corners increases, and the moving distance of the card 280 pushed by a protrusion of the cam decreases. Accordingly, the first cam 272 and the second cam 273 preferably have a shape with a small number of corners, and more preferably have a triangular shape.

A connector according to the embodiment of the present invention is described above. However, the present invention is not limited to the above-described embodiment.

What is claimed is:

1. A connector to be connected to another connector, the connector comprising:

a fixed contact;

a movable contact;

a housing having an opening into which the other connector is insertable;

a switch that is movable in a direction in which the other connector is inserted;

a cam that is rotatably supported and includes a first cam and a second cam; and a card that moves the movable contact, wherein the connector is configured such that when the other connector is inserted into the connector, the switch is pushed and moved by the other connector, the first cam is pushed by the switch and the cam rotates, the second cam pushes the card when the cam rotates, and the card moves the movable contact to contact the fixed contact.

2. The connector as claimed in claim 1, further comprising:

a spring that biases the card in a direction to cause the movable contact to move away from the fixed contact, wherein the connector is configured such that when the other connector is pulled out of the connector, the first cam is disengaged from the switch, and the card is moved by a biasing force of the spring and moves the movable contact away from the fixed contact.

3. The connector as claimed in claim 2, wherein the first cam includes a first protrusion and a second protrusion; and the connector is configured such that when the other connector is inserted into the connector, the first protrusion is pushed by the switch and the cam rotates in a first direction, and when the insertion of the other connector into the connector is completed, the card biased by the spring biases the second cam in a direction to cause the second cam to rotate in the first direction, the second protrusion contacts the switch, and the first cam is locked by the switch.

4. A connector device, comprising:

the connector as claimed in claim 1; and another connector to be inserted into the connector.

* * * * *